US010617216B2

(12) United States Patent
Kelley

(10) Patent No.: US 10,617,216 B2
(45) Date of Patent: Apr. 14, 2020

(54) TRASH COLLECTION DEVICE

(71) Applicant: Brian Robert Kelley, Potomac, MD (US)

(72) Inventor: Brian Robert Kelley, Potomac, MD (US)

( * ) Notice: Subject to any disclaimer, the term of this patent is extended or adjusted under 35 U.S.C. 154(b) by 0 days.

(21) Appl. No.: 15/887,957

(22) Filed: Mar. 6, 2018

(65) Prior Publication Data

US 2018/0220802 A1 Aug. 9, 2018

Related U.S. Application Data

(60) Provisional application No. 62/454,615, filed on Feb. 3, 2017.

(51) Int. Cl.

| | |
|---|---|
| ***A47C 7/62*** | (2006.01) |
| ***B65D 33/14*** | (2006.01) |
| ***A47C 7/56*** | (2006.01) |
| ***B65F 1/00*** | (2006.01) |

(52) U.S. Cl.

CPC ..... *A47C 7/62* (2013.01); *A47C 7/56* (2013.01); *B65D 33/14* (2013.01); *B65F 1/0013* (2013.01); *B65F 1/0006* (2013.01)

(58) Field of Classification Search

CPC . A47C 7/62; A47C 7/56; B65F 1/0013; B65F 1/0006; B65D 33/14

USPC ..... 248/99, 100, 234, 304, 322, 339; 297/188.01, 188.08; 211/16

See application file for complete search history.

(56) References Cited

U.S. PATENT DOCUMENTS

| | | | | | |
|---|---|---|---|---|---|
| 3,779,496 | A * | 12/1973 | Welles | B65B 67/1227 | 248/99 |
| 5,415,457 | A * | 5/1995 | Kifer | B60N 2/70 | 224/275 |
| 5,927,800 | A * | 7/1999 | Stallworth | A47C 7/56 | 297/188.08 |
| 6,098,933 | A * | 8/2000 | Stein | B65F 1/1415 | 248/99 |
| 2006/0103186 | A1* | 5/2006 | Sturt | B60N 3/103 | 297/188.1 |
| 2013/0140789 | A1* | 6/2013 | Paul | A47C 7/62 | 280/291 |

* cited by examiner

*Primary Examiner* — Muhammad Ijaz
(74) *Attorney, Agent, or Firm* — J.A. Lindeman & Co., PLLC

(57) ABSTRACT

Disclosed herein is a trash collection device. In some embodiments, the trash collection device is placed under a seat and multiple bags are available. By having multiple bags available, the amount of time for cleanup is reduced by not having to clean trash off the ground and by not having to replace bags after every use.

10 Claims, 6 Drawing Sheets

TRASH COLLECTION DEVICE

CROSS REFERENCE TO OTHER RELATED APPLICATIONS

This application claims priority to U.S. Provisional Application Ser. No. 62/454,615 filed on Feb. 3, 2017, which is hereby incorporated in its entirety.

TECHNICAL FIELD

This disclosure relates to the sanitation field. In particular, this disclosure relates to trash collection devices.

BACKGROUND

Stadiums draw a large number of people by hosting sporting events, concerts, political events, conventions, etc. Thousands and tens of thousands of people converge at a single venue. Such a large group of people offers an opportunity for selling merchandise and food. The people often bring their own food, plates, toiletries, etc. While trash cans are set up at exits and around the venue the trash cans fill up quickly and overflow and are not replaced in a timely manner. As a result, many patrons are left with trash and often leave the trash on the floor. There is a similar problem for movie theaters and indoor events as well. As a result, many hours, resources, and manpower are devoted to cleanup.

Many devices and instruments have been developed to make cleanup more efficient. One approach is placing bags and/or receptacles within or near seats. Providing a nearby trash bin provides both a convenience for patrons and serve to reduce the amount of cleanup when an event is finished. Having a personal trash bin serves as a way to entice patrons to throw away their garbage without having to search for a trash bin and not having to carry their trash with them.

But the state of the art leaves much to be desired. Some receptacles are inconveniently placed for the patron and do not provide a pleasurable experience. For example, placing a trash bag on the back of the seat. This creates an inconvenience for the patron and leads to confusion to whether a patron uses the bag in front or the one attached to their seat. Some devices place the bag underneath the seat, e.g., U.S. Pat. No. 5,927,800. This invention places a trash liner underneath a seat and a trash bag is placed in the liner. However, this creates several problems. First, the bag is a single bag device. This is troublesome in movie theaters where cleanup needs to happen quickly between screenings and having to replace multiple trash bags would cause more work. Second, the single use increases the amount of work for a cleanup crew by having to replace all the bags, and maybe the liner as well, within the venue space.

There exists a need for trash collection devices in public events. There exists a need for a trash collection device conveniently placed for patrons. There exists a need for a trash collection device offering multiple uses. There exists a need for a quick and efficient cleanup.

DETAILED DESCRIPTION

Disclosed herein is a new trash collection device. In one embodiment, the trash collection device is used in stadiums. In one embodiment, the trash collection device is used in movie theaters. In one embodiment, the trash collection device is used in outdoor events.

Disclosed herein is a new trash collection device placed under a seat. In one embodiment, the trash collection device comprises multiple trash bags allowing for multiple uses before restocking bags. In one embodiment, the trash bags are of the same material. In one embodiment, the trash bags are of different materials.

Disclosed herein is trash collection device, comprising:

a seat;

a fastener attached underneath the seat; and an object attached to the fastener underneath the seat; wherein the object is removable from the fastener.

In one embodiment, the object is a tray. In one embodiment, the object is a blanket. In one embodiment, the object is a box. In one embodiment, the object is a container. In one embodiment, the container is a bag.

Disclosed herein is a trash collection device, comprising:

a seat;

a fastener attached underneath the seat; and a container attached to the fastener underneath the seat; wherein the container is removable from the fastener.

As used herein, the term "seat" refers to a structure supporting a body, e.g., a body in a sitting position, a body standing on a seat, a body laying on a seat, etc. In one embodiment, a seat is a flat platform capable of supporting physical mass. In one embodiment, a seat is a flat platform capable of supporting physical mass above the ground. In one embodiment, a seat is a flat structure supporting a human body in the sitting position above the ground. In one embodiment, a seat is a chair. In one embodiment, a seat is a movie theatre seat. In one embodiment, a seat is a stadium seat. In one embodiment, a seat is a folding chair. In one embodiment, a seat is stationary. In one embodiment, a seat is movable.

Figure 2:
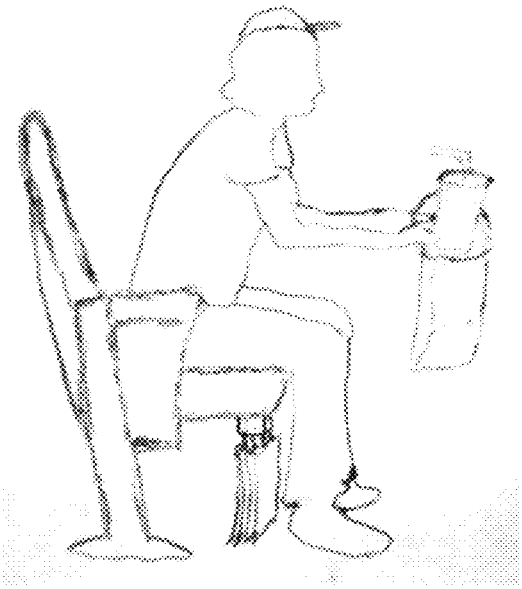
FIG. 2 is an illustrative example of a patron sitting in Chair 100 with Seat 101. Three Hooks 102 are attached to Block 103 with four holding Bags 104 while patron is using a Bag 104.

FIG. 2 is an illustrative example of a patron sitting in Chair 100 with Seat 101 and three Hooks 102 are attached to Block 103 holding four Bags 104 while patron is using a Bag 104.

As used herein, the term "fastener" refers to a device, material, or object holding and/or attaching two or more objects together. In one embodiment, a fastener holds two objects together. In one embodiment, a fastener attaches a larger object to a smaller object. In one embodiment, a fastener attaches an object to another object against the force of gravity. In one embodiment, a fastener keeps an object stationary. In one embodiment, a fastener is a screw. In one embodiment, a fastener is a staple. In one embodiment, a fastener is velcro. In one embodiment, a fastener is rope. In one embodiment, a fastener is an adhesive. In one embodiment a fastener is glue. In one embodiment, a fastener is permanently attached to the seat. In one embodiment, a fastener is removable. In one embodiment, a fastener is a hook. In one embodiment, a fastener is a block. In one embodiment, the devices disclosed herein comprise multiple fasteners. In one embodiment, an adhesive attaches one or more hooks to a seat. In one embodiment, one or more screws attaches one or more hooks to a block. In one embodiment, a fastener is attached to a seat.

Figure 5:
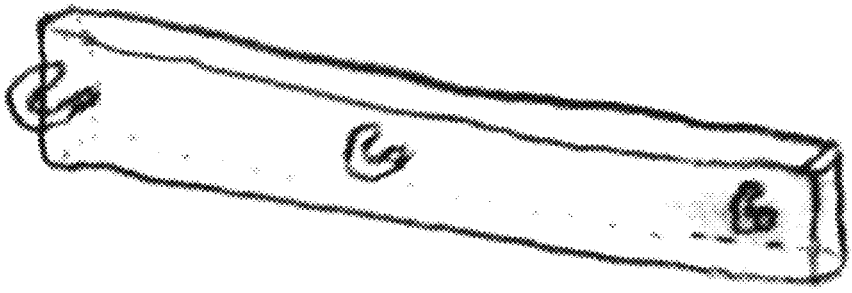
FIG. 5 is an illustrative example of three Hooks 102 attached to Block 103.

FIG. 5 is an illustrative example of three Hooks 102 attached to Block 103.

As used herein, the term "attached" refers to joined, connected, and/or bound. In one embodiment, a fastener is attached underneath a seat with a screw. In one embodiment, a fastener is attached underneath a seat with an adhesive. In one embodiment, a fastener is attached underneath a seat with a tape. In one embodiment, a fastener is attached underneath a seat with double sided tape. In one embodiment, a fastener is not permanently attached underneath a seat. In one embodiment, a fastener is permanently attached underneath a seat. In one embodiment, a block comprising one or more hooks is attached to a seat. In one embodiment, a block comprising one or hooks is attached to a seat and the block is removable from the seat. In one embodiment, one or more hooks are attached to a seat.

As used herein, the term "container" refers to an object capable of holding mass. In one embodiment, a container is a box. In one embodiment, a container is a crate. In one embodiment, a container is a can. In one embodiment, a container is a carton. In one embodiment, a container has an opening. In one embodiment, a container is a bag. In one embodiment, a cover encloses an opening of a container. In one embodiment, a container is flexible.

As used herein, the term "bag" refers to a flexible object opened at one end capable of holding mass. In one embodiment, a bag is made of canvas. In one embodiment, a bag is made of paper. In one embodiment, a bag is made of plastic. In one embodiment, a bag is made of compostable and/or recycled material. In one embodiment, a bag comprises graphics. In one embodiment, the graphics are designs and/or images. In one embodiment, a bag comprises writing. In one embodiment, a bag is flat and compressed when closed. In one embodiment, a bag is perforated.

As used herein, the term "perforated" means pierced, punctured, or pricked. In one embodiment, perforations allow for attaching multiple bags to a fastener at one time. In one embodiment, perforations allow for removing a bag removed one at a time leaving other bags still attached to a fastener. In one embodiment, perforations allow for easy removal of a bag for quick cleanup.

In one embodiment, a bag is a paper bag. In one embodiment, a bag is a plastic bag.

As used herein, the term "paper" refers to a composition manufactured from the pulp of wood or other fibrous substances, e.g., cellulose or lignin. Paper bags are environmentally sound and can be recycled or composted as opposed to other materials. Paper bags may also be more durable than other materials, e.g., plastic.

In one embodiment, the bag is a plastic bag.

As used herein, the term "plastic" refers to a synthetic material made from a polymer or polymers, e.g., polyethylene, high density polyethylene, PVC, nylon, etc. In one embodiment, a plastic is molded into a shape while soft and then set into a rigid or slightly elastic form. In some instances, plastic bags are more suitable to hold liquids than other materials, e.g., paper, cloth, etc. In one example, plastic bags are not permeable to liquids. In one example, paper bags do not become structurally compromised with liquids, e.g., water leaking, tearing when wet, etc. Impermeability of liquids is important to maintain cleanliness and to assist in cleaning. In one example, drinks not spilling onto the floor aids in lower cleanup time and cost. Preventing water damage also helps in the long term structural integrity of a venue.

In one embodiment, a fastener comprises an adhesive.

As used herein, the term "adhesive" refers to a substance capable of holding objects together. In one embodiment, an adhesive is a glue. In one embodiment, an adhesive is a paste. In one embodiment, an adhesive is cement. In one embodiment, the adhesive is an epoxy. In one embodiment, an adhesive is polyurethane. In one embodiment, an adhesive is a liquid. In one embodiment, an adhesive is a film. Adhesives offer certain advantages over other binding techniques, e.g., sewing, thermal bonding, etc., by binding different materials together, distributing stress more efficiently across the joint, being cost effective, improving aesthetic design, and increasing design flexibility.

In one embodiment, a fastener comprises one or more hooks.

As used herein, the term "hook" refers to a piece of material curved or angled suitable for holding an object against the force of gravity. In one embodiment, a hook is composed of metal. In one embodiment, a hook is composed of plastic. In one embodiment, a perforated bag is placed over one or more hooks. In one embodiment, an object is draped over one or more hooks. In one embodiment, one or more hooks are attached to a seat. In one embodiment, one or more hooks are attached to the devices disclosed herein. In one embodiment, one or more hooks are attached to a block.

In one embodiment, the devices disclosed herein comprise 1-3 hooks.

In one embodiment, the devices disclosed herein comprise 2-5 hooks.

In one embodiment, the devices disclosed herein comprise 3-7 hooks.

In one embodiment, the devices disclosed herein comprise 4-9 hooks.

In one embodiment, the devices disclosed herein comprise 5-10 hooks.

Figure 6:
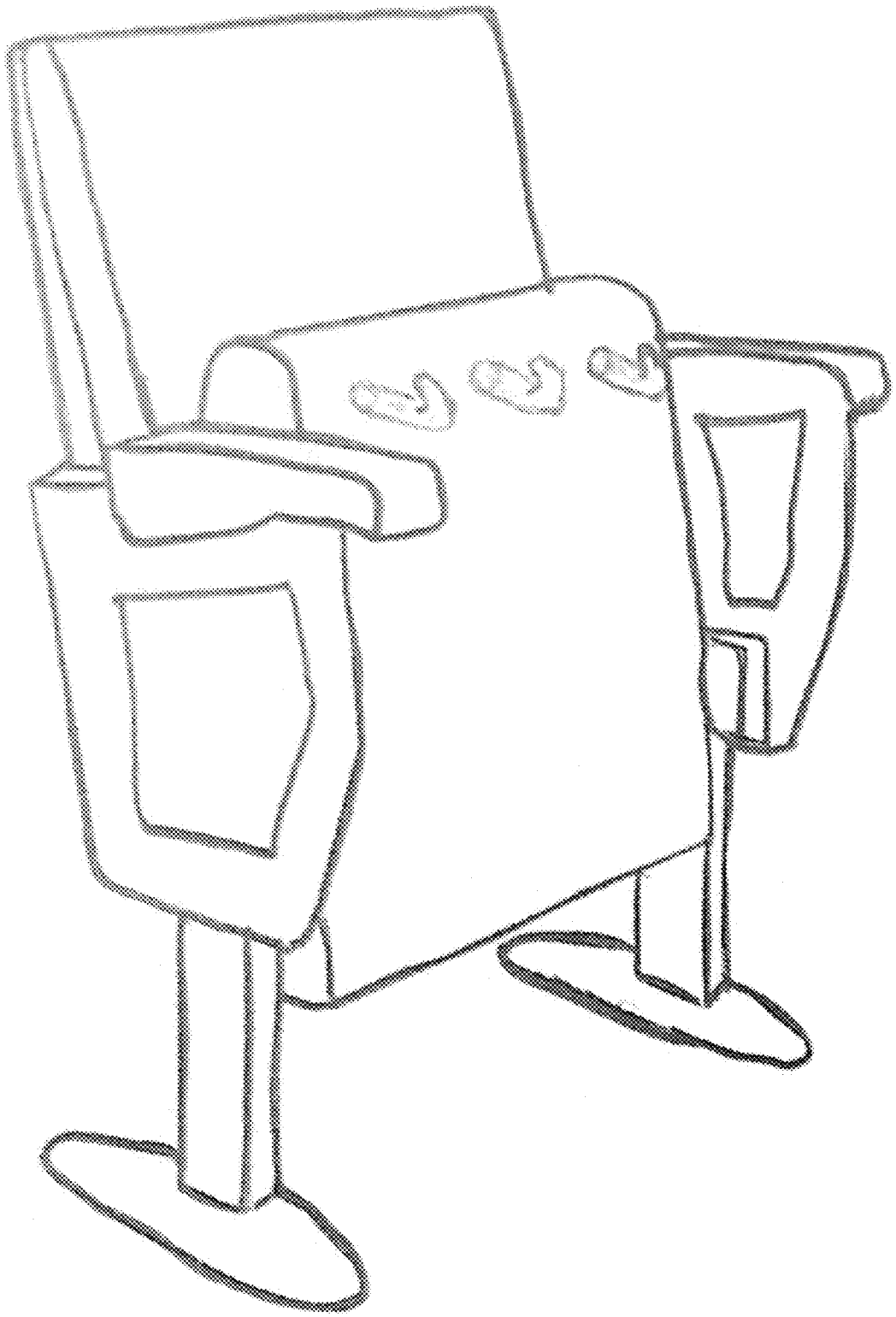
FIG. 6 is an illustrative example of Chair 100 with Seat 101 and three Hooks 102 imbedded into Seat 101.

FIG. 6 is an illustrative example of Chair 100 with Seat 101 and three Hooks 102 imbedded into Seat 101.

As used herein, the term "removable" refers to the ability of a thing to be separated from another thing. For example, a removable container refers to a container capable of being separated from a seat allowing the container to be replaced and not having to remove the entire device. In one embodiment, a bag is removable from a fastener. In one embodiment, a fastener is removable from a seat.

In one embodiment, the trash collection devices disclosed herein comprises multiple bags.

Figure 3:
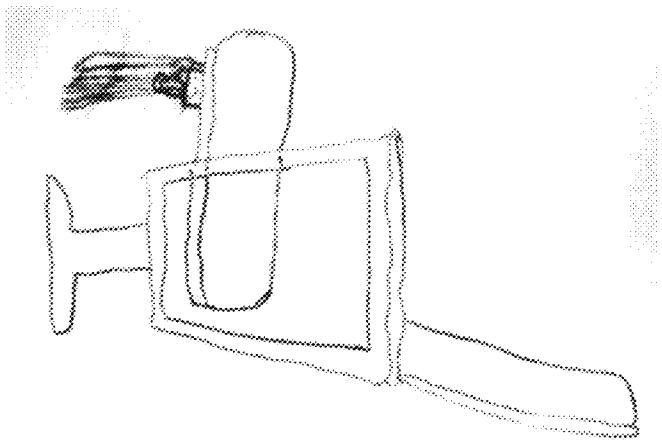
FIG. 3 is an illustrative example of Chair 100 with Seat 101. Three Hooks 102 are attached to Block 103 with six holding Bags 104.

FIG. 3 is an illustrative example of Chair 100 with Seat 101 and three Hooks 102 attached to Block 103 holding six Bags 104.

In one embodiment, the trash collection devices disclosed herein comprise 1-3 bags. In one embodiment, the trash collection devices disclosed herein comprise 2-4 bags. In one embodiment, the trash collection devices disclosed herein comprise 3-5 bags. In one embodiment, the trash collection devices disclosed herein comprise 4-10 bags. In one embodiment, the trash collection devices disclosed herein comprise 5-15 bags.

In one embodiment, the trash collection devices disclosed herein comprise a bag longer in length than the seat.

In one embodiment, the trash collection devices disclosed herein comprise a bag shorter in length than the seat.

Figure 4:
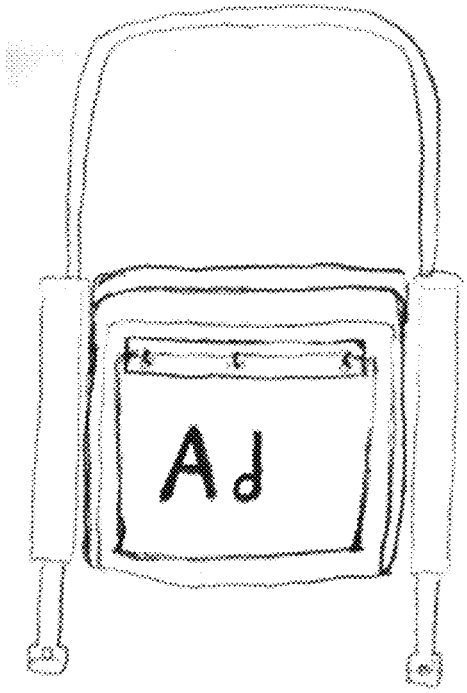
FIG. 4 is an illustrative example of a patron sitting in Chair 100 with Seat 101. Three Hooks 102 are attached to Block 103 with holding Bags 104. Seat 101 is in a closed position.

FIG. 4 is an illustrative example of a patron sitting in Chair 100 with Seat 101 and three Hooks 102 attached to Block 103 holding Bags 104 and Seat 101 is in a closed position. As illustrated Bag 104 is shorter in length than Seat 101.

In one embodiment, the trash collection devices disclosed herein comprise a bag wider in width than the seat.

In one embodiment, the trash collection devices disclosed herein comprise a bag narrower in width than the seat.

In one embodiment, the trash collection devices disclosed herein comprise a bag longer than the distance from the ground to the edge of a seat when a patron is sitting in the seat. This particular length of the bag allows the bag to rest on the ground behind the patron's feet at an angle, so the patron can rest their feet under the seat without being hindered by the bag.

In one embodiment, the trash collection devices disclosed herein comprise a bag extends to the length of the ground.

Figure 1:
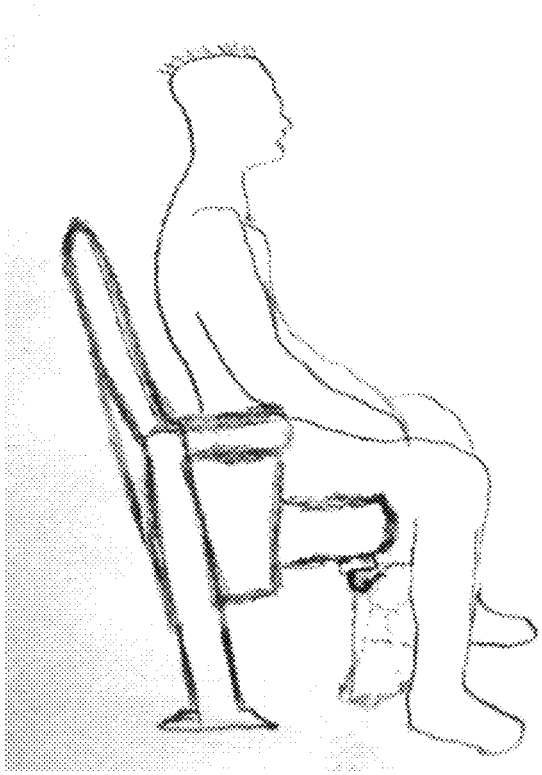
FIG. 1 is an illustrative example of a patron sitting in Chair 100 with Seat 101. Three Hooks 102 are attached to Block 103 with holding Bags 104. Seat 101 is in a sitting position.

FIG. 1 is an illustrative example of a patron sitting in Chair 100 with Seat 101 and three Hooks 102 attached to Block 103 holding Bags 104, and Seat 101 is in a sitting position. In this example Bag 104 extends to the ground.

In some instances, the size and type of material of the container may depend on the venue and manner being used. For example, a venue outside may require a container suitable for withstanding the elements and/or weather. As such, a plastic bag may be preferred over a paper bag in anticipation of precipitation, e.g., rain, snow, sleet, etc. In another example, a movie theater may require a smaller container to accommodate the comfort of patrons, e.g., a small plastic or paper bag.

As used herein, term "load carrying capacity" refers to the amount of weight a container can hold before compromising the structural integrity of the container. Different containers may have different load carry capacities based on construction, materials, size, number of perforations, etc. In one example, a plastic bag composed of thinner material may have a lighter load carrying capacity than a plastic bag composed of thicker material.

In one embodiment, a container has a load carrying capacity less than 1 lb of mass. In one embodiment, a container has a load carrying capacity greater than 1 lb of mass. In one embodiment, a container has a load carrying capacity less than 5 lbs of mass. In one embodiment, a container has a load carrying capacity greater than 5 lbs of mass. In one embodiment, a container has a load carrying capacity between 1-5 lbs of mass. In one embodiment, a container has a load carrying capacity between 2-10 lbs of mass. In one embodiment, a container has a load carrying capacity between 3-15 lbs of mass. In one embodiment, a container has a load carrying capacity between 4-20 lbs of mass. In one embodiment, a container has a load carrying capacity between 5-25 lbs of mass.

Although the disclosed invention has been described with reference to various exemplary embodiments, it is to be understood that these embodiments are merely illustrative of the principles and applications of the present invention. Those having skill in the art would recognize that various modifications to the exemplary embodiments may be made, without departing from the scope of the invention.

Moreover, it should be understood that various features and/or characteristics of differing embodiments herein may be combined with one another. It is therefore to be understood that numerous modifications may be made to the illustrative embodiments and that other arrangements may be devised without departing from the scope of the invention.

Furthermore, other embodiments of the invention will be apparent to those skilled in the art from consideration of the specification and practice of the invention disclosed herein. It is intended that the specification and examples be considered as exemplary only, with a scope and spirit being indicated by the claims.

Finally, it is noted that, as used in this specification and the appended claims, the singular forms "a," "an," and "the," include plural referents unless expressly and unequivocally limited to one referent, and vice versa. As used herein, the term "include" or "comprising" and its grammatical variants are intended to be non-limiting, such that recitation of an item or items is not to the exclusion of other like items that can be substituted or added to the recited item(s).

What is claimed is:

1. A trash collection device, comprising:

a seat;

at least one fastener that is surface mounted to an underside of the seat; and a plurality of perforated bags that are bundled and removably attached to the at least one fastener on the underside of the seat, wherein the plurality of bundled perforated bags includes perforations along a top portion of each of the plurality of bundled perforated bags, and wherein each of the plurality of bundled perforated bags is attached by a same perforation of each of the plurality of bundled perforated bags to the at least one fastener and each of the plurality of bundled perforated bags is individually removable from the bundled perforated bags and the at least one fastener, one of the plurality of bundled perforated bags at a time leaving a remainder of the plurality of bundled perforated bags removably attached to the at least one fastener, when the plurality of bundled perforated bags are attached to the at least one fastener;

the plurality of bundled perforated bags hang lengthwise along the underside of the seat when the seat is in a closed position, the plurality of bundled perforated bags hang lengthwise, from the perforations to a closed bottom portion of the plurality of bundled perforated bags, substantially vertical from the underside of the seat when the seat is in an in-use position, and wherein the at least one fastener includes a hook that extends from the underside of the seat and arcs back toward the underside of the seat to secure the plurality of bundled perforated bags when the seat is in an in-use position to prevent inadvertent removal of the bags.

2. The trash collection device of claim 1, wherein the bags are paper bags.

3. The trash collection device of claim 1, wherein the bags are plastic bags.

4. The trash collection device of claim 1, wherein the at least one fastener comprises an adhesive.

5. The trash collection device of claim 1, wherein the at least one fastener comprises a range of 1-5 hooks.

6. The trash collection device of claim 1, wherein the plurality of perforated bags includes a range of 2-10 bags.

7. The trash collection device of claim 1, wherein the plurality of perforated bags are longer in length than a depth of the seat.

8. The trash collection device of claim 1, wherein each of the plurality of perforated bags has a load carrying capacity greater than 1 lb.

9. The trash collection device of claim 8, wherein each of the plurality of perforated bags has the load carrying capacity greater than 5 lbs.

10. A trash collection device, comprising:

a seat;

at least one fastener that is surface mounted to an underside of the seat; and a plurality of perforated bags that are bundled and removably attached, by one or more perforations of the bags, to the at least one fastener on the underside of the seat, wherein the plurality of bundled perforated bags includes the one or more perforations along a top portion of each of the plurality of bundled perforated bags, the plurality of bundled perforated bags including an opening for placing objects into the plurality of bundled perforated bags near the top portion, and wherein the plurality of bundled perforated bags are attached by a same perforation of each of the bags to the at least one fastener and each of the bags is individually removable from the at bundled perforated bags and the least one fastener one bag at a time leaving a remainder of the plurality of perforated bags removably attached to the at least one fastener, and wherein the at least one fastener includes a hook that extends from the underside of the seat and arcs back toward the underside of the seat to secure the plurality of bundled perforated bags when the seat is in an in-use position to prevent inadvertent removal of the bags.

* * * * *